United States Patent [19]

Ogawa et al.

[11] 4,253,818

[45] Mar. 3, 1981

[54] IGNITING DEVICE

[75] Inventors: Syunji Ogawa, Tokyo; Seiichi Kitabayashi, Ageo, both of Japan

[73] Assignee: Nippon Gas Co., Ltd., Japan

[21] Appl. No.: 966,005

[22] Filed: Dec. 4, 1978

[30] Foreign Application Priority Data

Dec. 14, 1977 [JP] Japan ..... 52-150096
Mar. 20, 1978 [JP] Japan ..... 53-32173

[51] Int. Cl.[3] ..... F23Q 2/00

[52] U.S. Cl. ..... 431/142; 431/274; 431/276

[58] Field of Search ..... 431/273, 274, 276, 277, 431/254, 255, 127, 344, 130, 131, 142, 143, 150

[56] References Cited

U.S. PATENT DOCUMENTS

| | | | |
|---|---|---|---|
| 3,174,310 | 3/1965 | Genoud | 431/277 |
| 3,488,135 | 1/1970 | Quercia | 431/277 |
| 3,782,882 | 1/1974 | Goto | 431/150 |
| 3,895,903 | 7/1975 | Lefebvre | 431/143 |
| 3,938,943 | 2/1976 | Malamoud | 431/150 |

FOREIGN PATENT DOCUMENTS

| | | | |
|---|---|---|---|
| 795760 | 5/1958 | United Kingdom | 431/143 |

*Primary Examiner*—Samuel Scott
*Assistant Examiner*—Lee E. Barrett
*Attorney, Agent, or Firm*—Leydig, Voit, Osann, Mayer & Holt, Ltd.

[57] ABSTRACT

An igniting device wherein an elongated and hollow tubular body member is fixed at one longitudinal end to a gasifiable fuel container, a rotary member having an axial shaft extended at an end to the other extended end of the body member is rotatably born adjacent the fixed end of the body member, and gasified fuel discharged at the extended end of the body member is ignited by a flame generating means which cooperates with the extended end of the shaft of the rotary member. The flame generating means thus disposed at a remote end from the fuel container utilized as gripping part of the device enables it possible to ignite easily and reliably even burners located relatively deeply inside gas equipments.

8 Claims, 12 Drawing Figures

IGNITING DEVICE

The present invention relates to a simple and handy igniting device which is disposable without fuel replenishment and, more particularly, to an improved igniter provided with a flame generating portion of self-contained fuel burnt at an end of an elongated body for allowing easy ignition of burning equipments even when its burner to be ignited is generally located at a position relatively deep or hard to access as being inside the equipment.

Burning equipments not provided with automatic igniting means, such as portable burners for picnic, outdoor barbecue and the like purposes, require a manual ignition with a separate igniting means, but such ignition is difficult to achieve with ordinary igniting means including matches as the burner to be ignited is generally located at a relatively deep position inside the equipment especially when a kettle or the like is placed thereon.

For such burning equipments, there are already known semi-permanent igniting devices utilizing a spark generated by means of flint or an arc discharge generated by means of piezoelectric element. Such arc igniting devices function generally satisfactorily for gasified fuels but do not provide satisfactory ignition for fuels of a higher igniting point such as petroleum, kerosene, alcohol and the like, since the generated arcs last only momentary. Further, there is already known an igniting device self-containing a gasifiable fuel, battery and electrically igniting integrated circuit for continuously creating a flame of the fuel ignited, but such igniting device requires complicated structure and assembly so as to be inevitably expensive, in addition to high costs for the battery and integrated circuit. The present invention has been suggested in view of such defects of the known devices.

A primary object of the present invention is, therefore, to provide an igniting device provided with an elongated body for continuously creating a flame at an extended end of the device for enabling a reliable ignition of any fuel to be safely achieved even for a burner located deep inside or hard to access in the burning equipment.

An another object of the present invention is to provide an igniting device of a simple and inexpensive structure assuring a reliable ignition regardless of the igniting point of the fuel to be ignited.

A still another object of the present invention is to provide an igniting device which is suitable for mass production, extremely inexpensive and thus can be rendered disposable.

A further object of the present invention is to provide an igniting device provided with a safety lock mechanism rendering the ignition impossible by a single operation for thereby preventing unexpected ignition and thus ensuring safety in a simple and reliable manner.

A still further object of the present invention is to provide an igniting device provided with a swing preventing means allowing a reliable ignition even though the device is significantly longer than conventional or ordinary igniting devices.

Other objects and advantages of the present invention will become clear from the following description of the invention detailed with reference to a preferred embodiment shown in accompanying drawings, in which.

Figure 1:
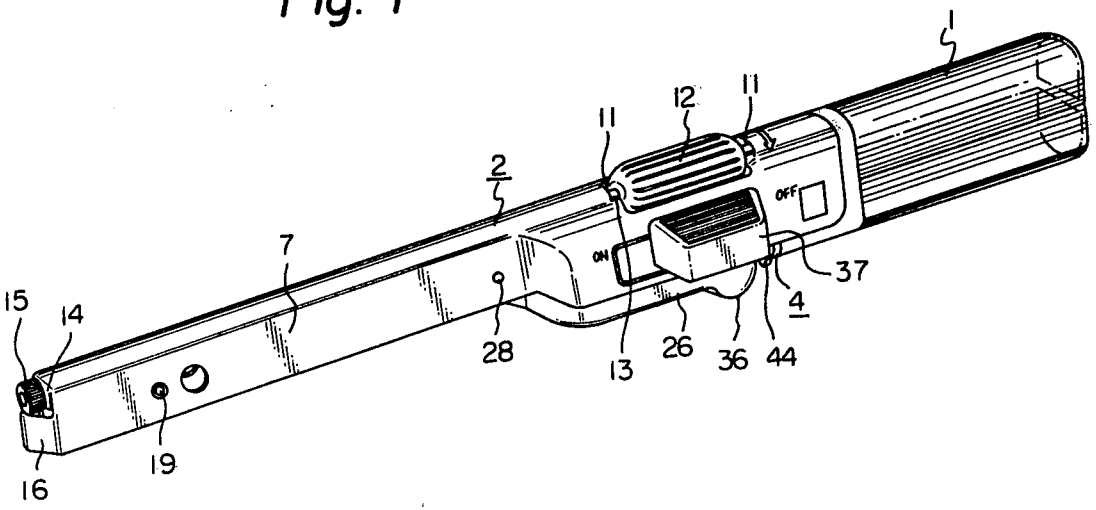
FIG. 1 is a perspective view of an igniting device in the preferred embodiment of the present invention.

While in the followings the present invention will be explained in detail with reference to the particular preferred embodiment illustrated, it should be understood that the intention is not to limit the invention to such embodiment only but to rather include all possible modifications, alternations and equivalent arrangements within the scope of appended claims.

Referring to FIGS. 1 to 6 showing the igniting device according to the present invention, the device substantially comprises a plastic-made fuel container 1 having no re-filling means, and an elongated and hollow and tubular body member 2 fixed to the container longitudinally in alignment with each other. The fuel container 1 contains a liquefied fuel gas such as butane gas, which can be emitted to a supply pipe 5 through a capillary tube 3 inserted into the container for capillary sucking the liquefied gas and providing it in gasified state at external end and through a valve 4 adapted to be opened and closed and to an adjustment of discharge rate of the fuel as will be further explained later.

Figure 7:
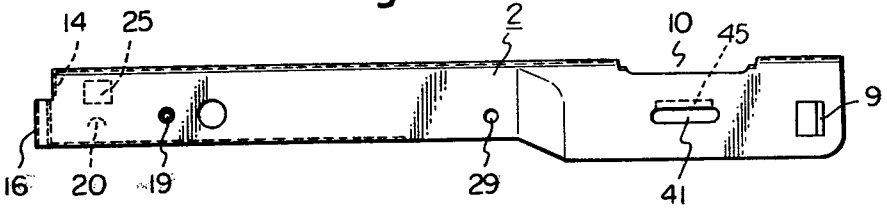
FIG. 7 is a side view of a tubular body member employed in the igniting device of the present invention.
Figure 8:
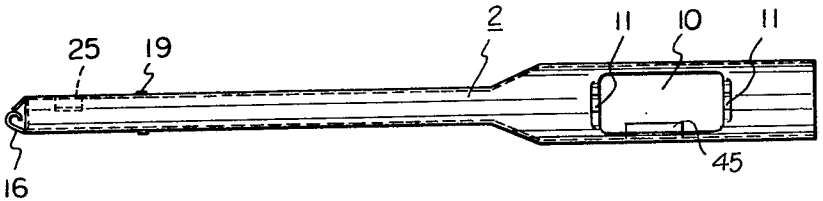
FIG. 8 is a plan view of the tubular body member shown in FIG. 7.
Figure 5:
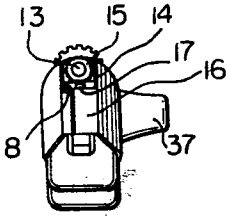
FIG. 5 is a front end view of the igniting device.
Figure 6:
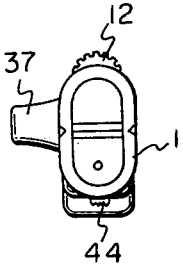
FIG. 6 is a rear end view of the igniting device.
Figure 9A:
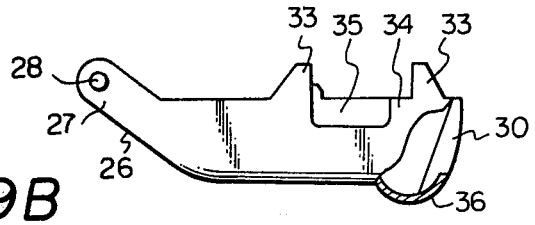
FIG. 9A is a side view of an actuating member employed in the igniting device of the present invention, with a part shown in section.
Figure 9B:
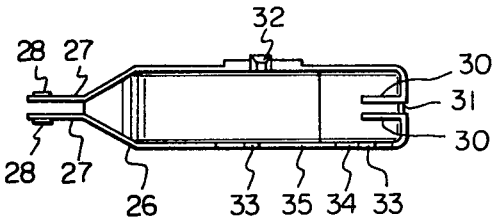
FIG. 9B is a plan view of the actuating member shown in FIG. 9A.
Figure 10A:
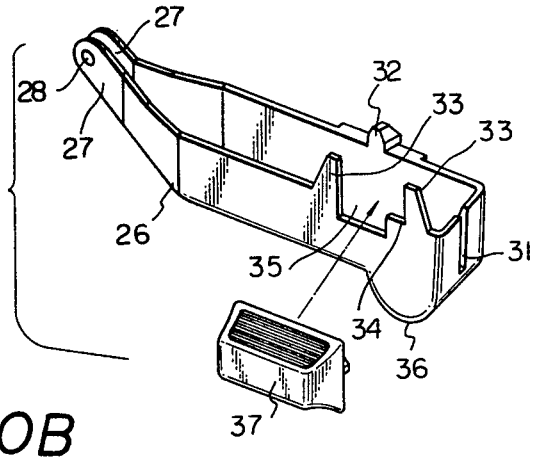
FIG. 10A is a perspective view as disassembled of the actuating member shown in FIGS. 9A and 9B and an operating button to be assembled with the member.
Figure 10B:
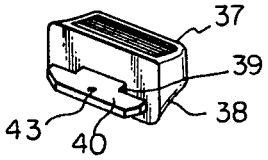
FIG. 10B is a perspective view of the operating button seen from the opposite side to that in FIG. 10A.

The hollow and tubular body member 2 is preferably made of a single plate bent into a form having a base portion 6 and a flat elongated portion 7 of which width is narrower than that of the base portion 6 as will be seen best in FIGS. 7 and 8, and the elongated portion 7 is provided at the front end thereof with a flame nozzle 8 as seen in FIG. 5. The base portion 6 is provided with inward projections 9 which are snap fitted at a plurality of positions with corresponding recesses provided on the fuel container 1, whereby the base portion 6 and tubular portion 7 are entirely firmly fixed to the container 1. In the upper part of the base portion 6, there is provided an aperture 10 which is formed to have at both longitudinal rims thereof recessed shaft bearing portions 11, while the lower part of the base portion 6 is left open.

In the aperture 10 of the base portion 6, there is accomodated a rotary member 12 of which shafts 13 protruding from both ends thereof are rotatably supported on the bearing portions 11, one of the shafts 13 protruding from the front end of the rotary member 12 being extended through the elongated portion 7 to the front end thereof where the shaft is supported in a hole provided in a support member 14 located in the vicinity of the flame nozzle 8. The shaft 13 is further provided, on the front end thereof extending from the supporting member 14, with a file wheel 15 rotatable with the shaft and, at the front end of the elongated portion 7, there is provided a flint holder 16 located close to the rotary file wheel 15 and open toward the same. In the flint holder 16, a flint 17 is disposed slidably in the axial direction thereof and is maintained in pressure contact with the rotary file wheel 15 by means of an end of a spring 18 inserted from the lower end of the flint holder 16. The spring 18 is wound at its bent part around a pin 19 provided across the interior of the elongated portion 7 and is supported at the other end by a supporting member 20 bent to project inside an inner wall of the elongated portion 7.

The valve 4, which being of a known structure generally employed in, for example, ordinary cigarette lighters, is provided with a rotary valve member 21 for regulating the gas discharge rate and formed to emit the gasified fuel from a nozzle pipe 22 when an expanded portion 23 formed on the nozzle pipe 22 is pulled in endwise direction of the pipe 22. To the nozzle pipe 22, the supply pipe 5 preferably made of a flexible plastic material is connected and in turn to an emission pipe 24 extending substantially parallel to the rotary shaft 13 of the rotary member 12 and reaching the flame nozzle 8, and the emission pipe 24 is firmly supported by a supporting member 25 bent to project inward from the inner wall of the elongated portion 7.

In the lower open side of the hollow tubular base portion 6, there is provided an actuating member 26 of a shape somewhat similar to a boat as shown in FIGS. 9A to 10B. The actuating member 26 is preferably made of a hard plastic material and provided at a longitudinal end thereof with two extended supporting arms 27, each having an outward pin 28 to be fitted in a supporting hole 29 provided in the elongated portion 7 close to the base portion 6, whereby the entire actuating member 26 is rendered rotatable about the pins 28. The actuating member 26 is provided at the other longitudinal end thereof with a slanted surface 30 and further with a notch 31 allowing the other end of the member to be inserted between the rotary valve member 21 and the expanded portion 23 on the nozzle pipe 22. Further, the actuating member 26 is provided on a side face with a hook 32 engageable with a rim of an aperture 46 made in a side wall of the base portion 6, and is further provided on the other side face with a pair of upward projections 33, between which there are provided a recess 35 and a shoulder portion 34 of the same level as the upper rim of the member 26. Further, at the lower rear portion of the actuating member 26, there is provided a triggering portion 36 bulged downward.

A slidable button member 37 is slidably mounted on the base portion 6 of the hollow tubular member 2, and this button member 37 comprises a main body member 38 and an engaging member 40 connected thereto by a connecting portion 39, while the engaging member 40 is formed to be larger than the connecting portion 39 and slidably fitted in a slit 41 provided in a side face of the base portion 6 to extend in longitudinal direction of the body member 2. In this case, the connecting portion 39 and engaging member 40 extend inward the base portion 6 to engage with the actuating member 26 in such a manner that the connecting portion 39 is aligned with the recess 35 of the actuating member 26 to allow its upward or inward rotation about the pins 28 when the slidable button 37 is positioned at the forward end of the slit 41 on the side of the elongated portion 7 and that the connecting portion 39 rides over the shoulder portion 34 of the actuating member 26 to prohibit the rotation thereof when the slidable button 37 is positioned at the rearward end of the slit 41 on the side of the fuel container 1.

Figure 2:
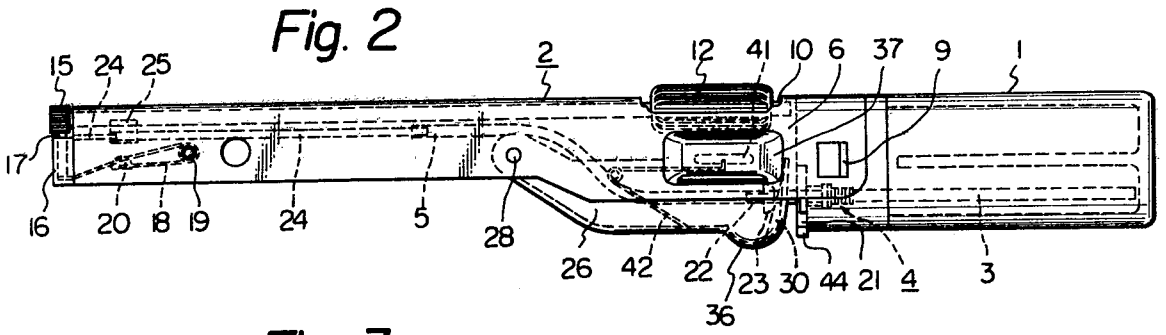
FIG. 2 is a side view of the igniting device of FIG. 1, wherein a part of internal structure is represented by broken lines.
Figure 3:
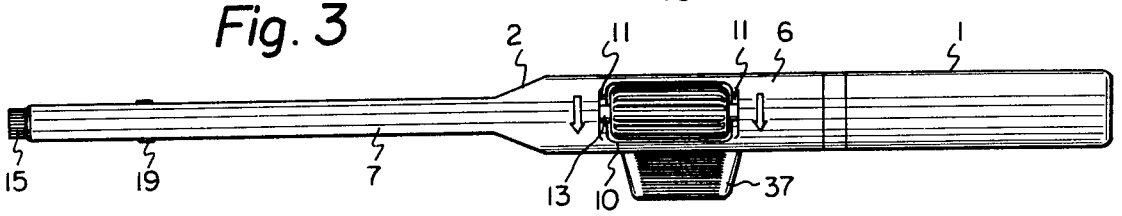
FIG. 3 is a plan view of the igniting device.
Figure 4:
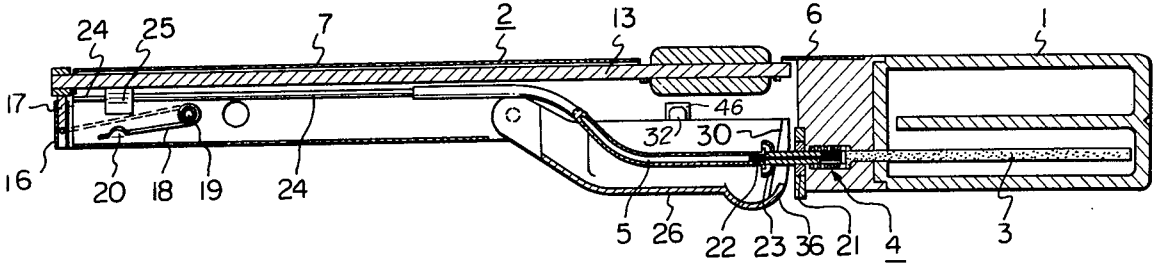
FIG. 4 is a longitudinal cross-sectional view of the igniting device.

As seen in FIG. 2, a resetting spring 42 accomodated in a space defined inside the base portion 6 and actuating member 26 is fixed at an end to a hole 43 provided in the engaging portion 40 of the slidable button 37 and at the other end engaged with the internal bottom wall of the actuating member 26, whereby the force of the resetting spring 42 functions to normally urge the actuating member 26 to a position where the hook 32 of the member abuts a rim of an aperture 46 provided in the side wall of the base portion 6. An adjust knob 44 associated with the valve 4 is extended downward from the rotary valve member 21 positioned on an end face of the fuel container 1 for easy control of the valve 4. Further, in the base portion 6, there is provided preferably a projecting guide 45 extending along the upper edge of the slit 41 to ensure the guide of the slidable button 37 and its smooth sliding action along the slit.

The operation of the igniting device of the present invention shall now be described in the followings.

Now, the fuel container 1 is held in hand and the slidable button 37 is displaced to the forward end of the slit 41 marked "ON" on the exterior of the base portion 6, as in FIG. 1, i.e. toward the elongated portion 7 of the body member 2, so that the connecting portion 39 of the slidable button 37 is aligned with the recess 35 of the actuating member 26 to allow its upward or inward rotation. Then, the actuating member 26 is rotated fully upward or inward the portion 6, the rear slanted face 30 of the member 26 is caused to slide along the expanded portion 23 so as to be inserted, due to the presence of the notch 31, between the rotary valve member 21 and the expanded portion 23 of the nozzle pipe 22, thereby the portion 23 and pipe 22 are pulled outward to open the valve 4 and the gasified fuel is emitted from the nozzle pipe 22 in an amount controlled by a set position of the rotary valve member 21. The fuel emitted from the nozzle pipe 22 instantaneously reaches the flame nozzle 8 through the feed pipe 5 and emission pipe 24. In this state, by rotating the rotary member 12 with a finger in a direction of an arrow marked on the upper surface of base portion 6, as in FIG. 1, the rotary file wheel 15 is rotated with the shaft 13 to generate sparks in the vicinity of flame nozzle 8 and the gasified fuel emitted from the emission pipe 24 is ignited by the sparks to generate a flame continuously as long as the actuating member 26 is held in its rotated position.

Also it will be understood that a finger which is normally the thumb moved over the rotary member 12 in crosswise direction to the longitudinally direction of the device for rotating the rotary member 12 will fall naturally onto the slidable button 37. Thus, even after a relatively large action of the finger causing the rotation of the rotary member 12 is applied to the igniting device, the finger is instantly settled on the slidable button 37, whereby the particular finger and palm as well as other fingers grasping the fuel container 1 function to prevent the generation of any large swing of the device accompanying the rotating action, assuring the ignition of gasified fuel in a fixed stable position of the device. Further, the thumb rested on the button 37 causes a continuous depression of the actuating member 26 into its rotated position normally by means of the forefinger to be easier.

Although in the foregoing description the respective actions for sliding the slidable button 37, rotating the rotary member 12, rotating the actuating member 26 and stably holding the device with the thumb on the slidable button 37 have been explained as if these actions are performed separately one by one, it will be understood that these actions are practically carried out sequentially in a moment.

On the other hand, when the slidable button 37 is pulled to the rearward end of the slit 41 marked "OFF" in FIG. 1, the connecting portion 39 is positioned on the shoulder portion 34 of the actuating member 26 to restrict any upward rotation of the member, so that the expended portion 23 as well as the nozzle pipe 22 cannot be pulled away from the rotary valve member 21 and the fuel cannot be emitted. Thus the flame cannot be generated even if the rotary file wheel 15 is rotated by the rotation of the rotary member 12. In this manner, the slidable button 37 acts not only as a part of the swing stopping means but also as a part of a safety lock means of the device.

Further, as the actuating member 26 is secured in the position by means of the resetting spring 42 fixed at an end to the engaging member 40 of the slidable button 37, the arrangement is effective not only to secure the button 37 to the slit 41 on the one side of the base member 6 in the slidable manner but also to positively engage the hook 32 of the actuating member 26 with the rim of the aperture 46 on the other side of the base portion 6 with a reaction of the other end of the spring 42 acting on the member 26 as biased on said the other side of the portion 6.

As explained in the foregoings, the igniting device of the present invention is capable of providing a reliable and safe ignition of burners even when the burners are hard to access since the igniting flame is generated at the extended end of the device remote from the gripping part thereof and, therefore, can be effectively utilized even for burning equipments utilizing a fuel of a higher igniting point. Further, as the structure of the device is simple and is thus suitable for mass production, manufacturing costs of the device can be reduced well enough for rendering the device to be disposable when the fuel contained is wasted. In addition, the presence of the safety lock means prevents any unexpected ignition of the device.

What we claim as our invention is:

1. An igniting device comprising a container of a gasifiable fuel, said container having means for adjusting the discharge rate of said fuel, an elongated and hollow body member fixed at one longitudinal end to said fuel container, an igniting means comprising a rotary member rotatably supported adjacent said fixed end of said body member and having an axial shaft extended from an end inside the body member to the other end thereof and a spark generating means disposed at said other end of the body member and operatively coupled to said extended end of said shaft, means operatively engaging said adjusting means of the fuel container for opening and closing the adjusting means, means for feeding said fuel from the fuel container to the vicinity of said spark generating means, means for locking said opening and closing means for said fuel discharge rate adjusting means to a non-operative state, said locking means including a button mounted on said body member for slidable movement between locking and releasing positions, said opening and closing means including an actuating member pivoted at one end thereof on said body member and shiftable at another end thereof between non-actuating and actuating position, and said slidable button being engaged with said other end of said actuating member when the button is slid to said locking position for locking the actuating member in said non-actuating position.

2. An igniting device according to claim 1, wherein said hollow elongated body member comprises a base portion having on the upper part thereof an aperture for accommodating said rotary member of said igniting means and opened at the lower part thereof for mounting inside the body member said opening and closing means, and an elongated portion of a width smaller than that of said base portion and provided at an end thereof with said spark generating means.

3. An igniting device according to claim 2, wherein said hollow elongated body member is formed with a single plate.

4. An igniting device according to claim 1, wherein said spark generating means comprises a rotary file wheel fixed to said extended end of the shaft of the rotary member, and a flint supported in a flint holding means provided at said other end of the elongated body member for urging said flint against said rotary file wheel.

5. An igniting device according to claim 1, wherein said actuating member is normally biased to a non-actuating position, said adjusting means comprises a valve means including a rotary valve member and a nozzle member to be opened when separated from said rotary valve member, and said actuating member further includes a member adapted to be inserted between the rotary valve member and the nozzle member for separating both members from each other accompanying a pivoting shift of the actuating member from said non-actuating position to an actuating position.

6. An igniting device according to claim 1, wherein said actuating member is provided with a recess and a shoulder portion adjacent said recess so that said slidable button will be positioned in said recess when the button is moved to said releasing position to allow shifting of said actuating member said button is located over said shoulder portion when the button is moved to said locking position to restrict the shifting of the actuating member, whereby a safety lock mechanism of the device is achieved by the actuating member and button.

7. An igniting device according to claim 6, wherein said slidable button is disposed adjacent said rotary member of said igniting means and on a side of rotating direction of the rotary member, whereby a swing stopping mechanism of the device is achieved by the button.

8. An igniting device according to claim 6, wherein said actuating member includes a resetting spring which normally biases the actuating member to said non-actuating position, said spring engaging one end of the actuating member at a position remote from said pivoted end and being secured at the other end to said slidable button, and said body member and actuating member are provided with elements of an engaging means, respective said elements being engageable with each other when the actuating member is in its said non-actuating position.

* * * * *